US008742274B2

(12) United States Patent
Hammermayer

(10) Patent No.: US 8,742,274 B2
(45) Date of Patent: Jun. 3, 2014

(54) SWITCHING DEVICE

(75) Inventor: Ernst Hammermayer, Vienna (AT)

(73) Assignee: Moeller Gebaeudeautomation GmbH, Schrems (AT)

( * ) Notice: Subject to any disclaimer, the term of this patent is extended or adjusted under 35 U.S.C. 154(b) by 831 days.

(21) Appl. No.: 12/280,818

(22) PCT Filed: Feb. 26, 2007

(86) PCT No.: PCT/AT2007/000098
§ 371 (c)(1),
(2), (4) Date: Aug. 27, 2008

(87) PCT Pub. No.: WO2007/098516
PCT Pub. Date: Sep. 7, 2007

(65) Prior Publication Data

US 2009/0038920 A1 Feb. 12, 2009

(30) Foreign Application Priority Data

Mar. 2, 2006 (AT) ..... A 354/2006
Sep. 1, 2006 (AT) ..... A 1458/2006

(51) Int. Cl.
*H01H 13/04* (2006.01)
*H01H 71/02* (2006.01)

(52) U.S. Cl.
USPC ..... 200/333; 200/43.15

(58) Field of Classification Search
USPC ..... 200/43.01, 43.02, 43.14–43.17, 303, 200/329, 333, 334
See application file for complete search history.

(56) References Cited

U.S. PATENT DOCUMENTS

| | | | | |
|---|---|---|---|---|
| 4,872,087 | A | | 10/1989 | Brant |
| 4,882,456 | A | * | 11/1989 | Hovanic et al. ..... 200/43.15 |
| 5,607,047 | A | * | 3/1997 | Leet et al. ..... 200/303 |
| 5,894,404 | A | | 4/1999 | Vrnak et al. |
| 5,909,019 | A | | 6/1999 | Maloney et al. |

FOREIGN PATENT DOCUMENTS

| | | | |
|---|---|---|---|
| DE | 1 858 963 | | 9/1962 |
| DE | 27 48 431 | | 10/1977 |
| DE | GM 77 29 230 | | 1/1978 |
| DE | 27 39 632 | | 11/1978 |
| DE | G 86 03 315.8 | | 10/1987 |
| DE | 38 12 674 | A1 | 2/1990 |
| DE | G 92 02 764.4 | | 6/1992 |
| DE | 195 12 830 | A1 | 10/1996 |
| DE | 196 53 300 | A1 | 6/1998 |
| EP | 0 331 383 | A2 | 9/1989 |
| EP | 0 375 488 | A1 | 6/1990 |
| EP | 0 753 872 | A1 | 1/1997 |
| EP | 0 849 757 | A2 | 6/1998 |

OTHER PUBLICATIONS

Translation of EP 849757 A2 Moessner et al. Jun. 1998, Printed May 14, 2012, pp. 1-3.*

* cited by examiner

*Primary Examiner* — Amy Cohen Johnson
*Assistant Examiner* — Marina Fishman
(74) *Attorney, Agent, or Firm* — Henry M. Feiereisen LLC

(57) ABSTRACT

In a switching device (1), in particular a line circuit breaker and/or a residual current circuit breaker, having a housing (2) and having switching contacts for closing and/or opening at least one circuit, wherein a tripping apparatus for automatically disconnecting the switching contacts is provided, wherein the housing (2) has at least one front side (3), the invention proposes, for the purpose of meeting changing requirements from the market or the customers quickly, flexibly and at favorable cost, clipping a cover cap (4) onto the front side (3).

18 Claims, 7 Drawing Sheets

SWITCHING DEVICE

BACKGROUND OF THE INVENTION

The invention relates to a switching device, especially a miniature circuit breaker or a residual current circuit breaker, comprising a housing and switching contacts for closing and/or opening at least one circuit, with a tripping apparatus for automatically disconnecting the switching contacts being provided, with the housing having at least one front side.

Switching devices, especially circuit breakers such as miniature circuit breakers and/or residual current circuit breakers, are known which are sold and applied with substantially the same functionality in many countries of the earth. Such switching devices have the same identical interior configuration in a large number of countries. However, the local regulations differ in many countries concerning the necessary labeling of a switching device. It may be necessary in country A to provide certain forms of labeling in the form of imprints on the switching device, whereas in country B it is necessary to have other markings which must be arranged not in the form of an imprint but in the form of a relief incorporated in the switching device. It is further known to purchase switching devices from third-party makers or to sell the same to third-party suppliers. In this case it is necessary to adjust the switching device not only to the firm's name concerning the firm's labeling, but the configuration of the switching device is to be adjusted to the configuration of the other switching devices of said third-party firm.

It was therefore necessary to date to produce switching devices with separate housings for each market or for each third-party supplier. Since the housings for switching devices such as miniature circuit breakers or residual current circuit breakers are arranged in a very complex way due to the necessary functionality and especially have a very complex arranged interior configuration, the necessary injection-molding and extruder molds are very complex and expensive and the production of a new mold takes a long time. This leads to high costs in the production of different housing shapes and for stocking different housing shapes. This also reduces the producer's flexibility, who needs to use different housings for each market. The complex production of the housing which requires a long period of time can occur only very slowly and with long delays to customers' requirements and to new or changed markets.

SUMMARY OF THE INVENTION

It is the object of the invention to provide a switching device of the kind mentioned above with which the mentioned disadvantages can be avoided and which allows a simple and cost-effective production and enables a quick, flexible and cost-effective response to changed requirements by the market or customers.

This is achieved in such a way that a cover cap is clipped onto the front side.

The production of a switching device can thus be arranged in a simple and cost-effective way, enabling a quick and flexible response to changed requirements by the market or the customers. A switching device can thus be produced which can be produced with the same functionality for all markets, countries and/or customers, with the adaptation of the switching device to the respective market, customer and/or country being enabled by the arrangement of a respective cover cap. Merely a single housing can thus be used in the production of the switching device, thus avoiding production expenditure for different housings. Production of the switching device can thus be simplified because production does not have to take into account the final place of assignment of the switching device. The adaptation of the switching device to the market can be made in a flexible way, e.g. in a final production step. Since the cover cap is arranged in a small and simple way, the different shapes for different cover caps can be arranged in a simple way and can be produced in a substantially faster way than a mold for a complete housing. This allows production to respond rapidly to changes or requirements by the market and/or customers, such that new cover caps can be produced in a relatively short period of time which are arranged on the finished switching devices.

The clipping of a cover cap can also substantially simplify the production of a switching device in accordance with the invention. The clipping process can be performed both manually or in an automated way simply by a robot, with an especially simple and durable arrangement of the cover cap on the switching device being achieved by the clipping.

It can be provided in a further development of the invention that the cover cap comprises at least one latching nose which engages in at least one latching groove arranged in the area of the front side. This ensures favorable anchoring of the cover cap on the housing of the switching device. This ensures a secure latched connection of the cover cap with the housing.

According to a further embodiment of the invention it can be provided that the cover cap and the housing are arranged in such a way that they prevent destruction-free opening and especially destruction-free bending of the latched connection between latching groove and latching nose when the cover cap is clipped onto the front side. This helps prevent the removal of the cover cap in a readily mounted switch, thus increasing the operational reliability of the switch.

In this connection it can be provided in a further development of the invention in a switching device in accordance with the invention which comprises a projection of the housing which forms the front side at least in sections and which converges into the housing in at least one base area, with a switching lever being arranged in the area of the projection of the housing, that the cover cap is connected with the housing and/or housing projection in a securing connection especially in the area of at least a base area and that the securing connection is arranged in such a way that it prevents destruction-free opening and especially destruction-free upward bending of the latched connection. This can effectively and simply prevent the removal of the cover cap in a readily mounted switch, which thus increases the operational reliability of the switch.

In a further embodiment of the invention it can be provided that in the region of the base area, especially in the direct transition of the projection to the housing, at least one securing groove is formed in the housing and the cover cap engages in said securing groove and thus forms the securing connection. An especially simply arranged and highly effective securing connection can thus be created which promotes automated assembly of the switch.

In this connection it can be provided in a further embodiment of the invention that the at least one latched connection is arranged in the region between the securing connection and the apex zone of the projection of the housing. By displacing the securing connection away from the regions closest to the user, it can be arranged in a substantially non-visible way and is thus additionally protected from subsequent changes and does not impair the areas necessary for labeling the switch.

One variant of the invention in which the front side is formed by the projection of the housing and said projection substantially has the shape of a rectangular cuboid placed on the housing with a first and second face surface can be that in the region of the base area of the first and second face surface a securing groove each is arranged and that the cover cap comprises a securing projection each while resting on the first and second face surface which engages in the securing groove and thus forms a securing connection each in the area of the first and second face side. This enables an especially secure configuration and arrangement of the securing connection which is not accessible to any unauthorized interventions.

According to yet a further embodiment of the invention in which the housing is formed by at least two housing shells which are placed against each other with their free boundary edges and are riveted together, it can be provided that a latching groove each is arranged on the first and second face surface merely on one of the two housing shells. In this way, the changes in the design of the necessary tools for forming the housing shells, especially the injection molds, can be limited to merely one housing shell, through which the costs for the necessary changes can be kept low.

It can be provided according to a further embodiment of the invention in a switching device with a housing which is formed by at least two housing shells which are placed against each other with their free boundary edges and are riveted together, with the housing shells each having riveting tubes converging into each other for receiving the rivets, that the at least one latching groove is formed by an outside area of the rivet tubes. As a result, the rivet tubes which are present in the housing anyway are used for a further purpose, namely as a latching groove for clipping on the cover cap. One can thus omit further latching grooves which would especially need to be provided in other areas of the housing. This ensures an especially simple and cost-effective arrangement of the housing. An existing housing construction can thus be further used with only minimal changes in a substantially unchanged manner. A switching device with such a housing also especially has an especially high mechanical stability and torsional stiffness since forces acting upon the cover cap or transmitted by the same are transmitted directly onto the rivet tubes via the latching noses, which is why there is no further twisting of the housing.

It can be provided in a further development in a switching device in which the front side and the cover cap have a substantially rectangular basic surface that in the area of the four front-side corners at least one latching groove each is arranged and in the area of the four cover corners at least one latching nose each. An especially favorable and stable fastening of the cover cap on the housing is achieved.

It can be provided in a further development of the invention in a switching device in which the front side comprises a first breakthrough for leading through a switching lever that the cover cap substantially completely covers the front side and comprises a second breakthrough which is at least as large as the first breakthrough. The entire front side can thus be adjusted to the requirements by the market, customers and/or regulations of a country.

According to yet another embodiment of the invention, it can be provided in a switching device in which the housing comprises two substantially parallel side surfaces of the housing that the cover cap comprises at least one cover side surface which is substantially flush with the adjacent side surface of the housing. A torsionally rigid cover cap can thus be created which also withstands the loads applied by a production robot. A switching device is thus formed which does not have any visible or accessible housing joints in the area accessible to the user.

According to a further embodiment of the invention it can be provided that the second breakthrough in the area of the cover side surface is delimited by at least one rib, especially two ribs. The switching lever can thus be protected against the action of lateral forces and can be guided.

It can be provided within the terms of a further development of the invention that the at least one rib comprises at least one hole, especially two holes, for guiding through the switching lever arresting element, e.g. a wire. The switching lever can thus be arrested in one of the two end positions in order to prevent any unauthorized actuation of the switching device.

One variant of the invention can be that the cover cap comprises a third breakthrough for a switch position indicator. The position of the switching contacts can be displayed even when using a cover cap, with the third breakthrough being adjusted in respect of its shape and configuration to the demands of a market and/or a third-party supplier.

BRIEF DESCRIPTION OF THE DRAWING

The invention is now explained in closer detail by reference to the enclosed drawings which merely show preferred embodiments by means of examples, wherein.

DETAILED DESCRIPTION OF PREFERRED EMBODIMENTS

Figure 1:
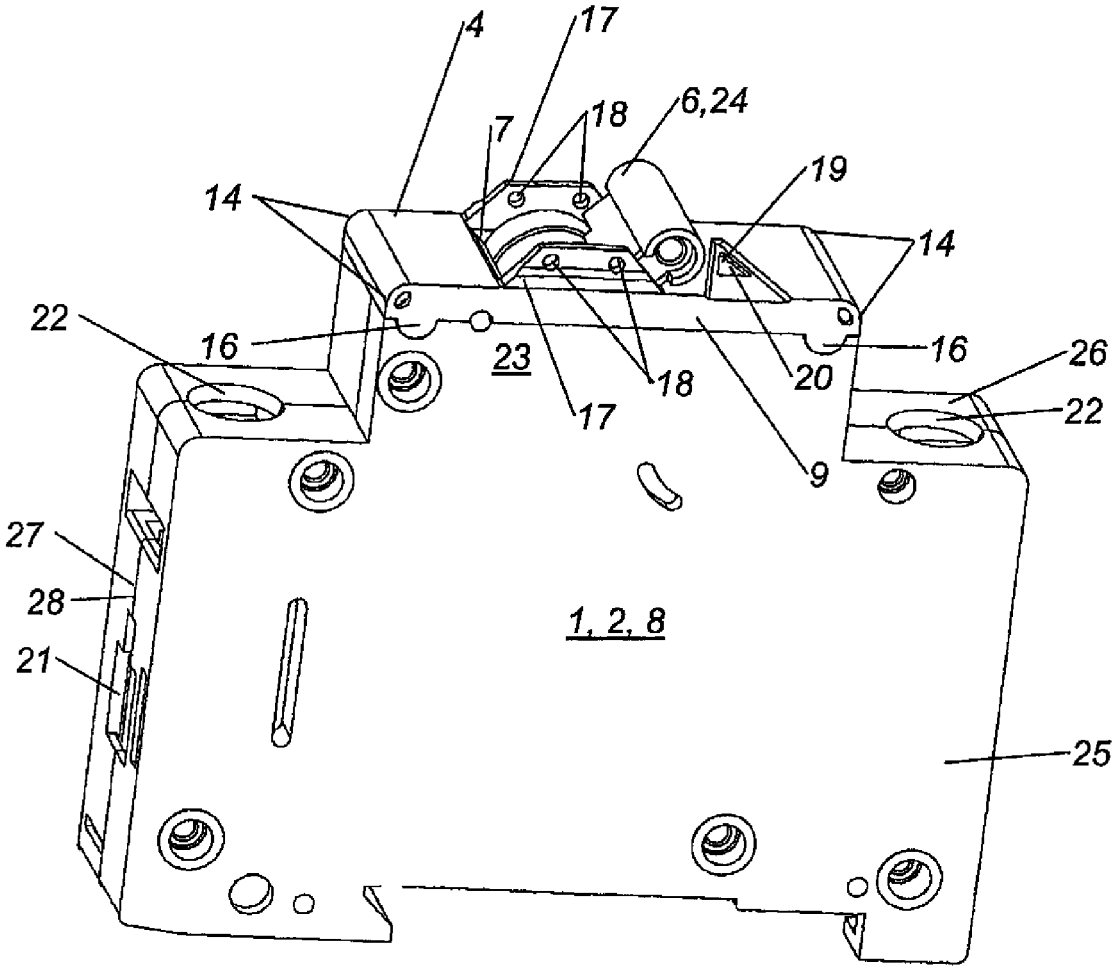
FIG. 1 shows a first embodiment of a switching device in accordance with the invention with a cover cap.
Figure 6:
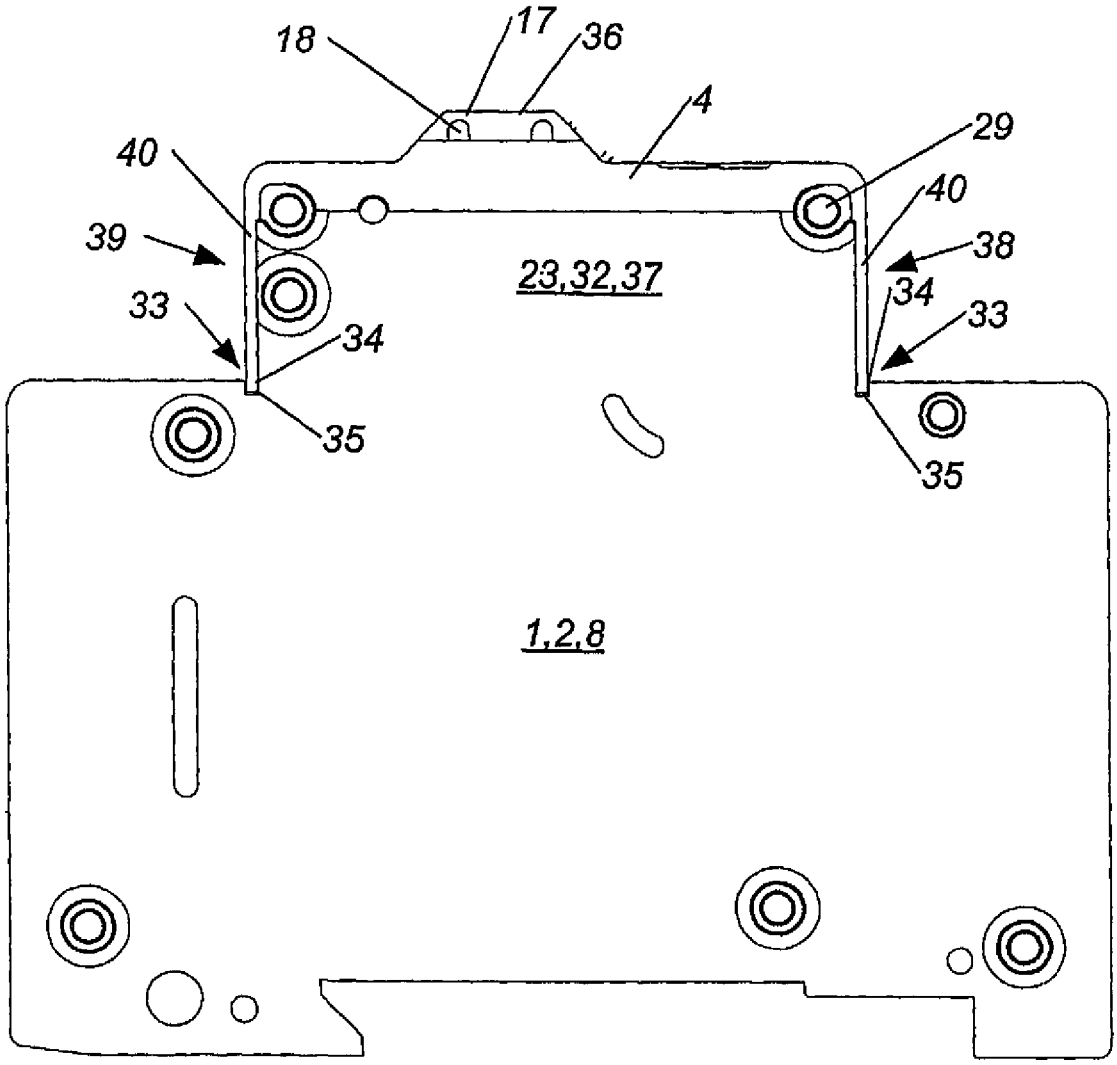
FIG. 6 shows a switching device according to FIG. 5 with a cover cap arranged on the same.

FIGS. 1 and 6 show especially preferred embodiments of a switching device 1, comprising a housing 2 and switching contacts for closing and/or opening at least one circuit, with a tripping apparatus being provided for automatically separating the switching contacts and with the housing 2 comprising at least one front side 3, with a cover cap 4 being clipped onto the front side 3.

The measures in accordance with the invention allow making the production of a switching device 1 in a simple and cost-effective way that can rapidly and flexibly respond to changed requirements by the market or customers. A switching device 1 can thus be produced which can be made with the same functionality for all markets, countries and/or customers, with the adaptation of the switching device 1 to the respective market, customer and/or country being made by arranging a respective cover cap 4. Merely one single housing 2 can thus be used in the production of the switching device 1, thus avoiding the production expenditure for different housings 2. The production of the switching device 1 can thus be simplified because production no longer needs to consider the final place of assignment of the switching device 1. The adaptation of the switching device I to the market can be made flexibly, e.g. in a final production step. Since the cover cap 4 is arranged in a small and simple way, different production molds for different cover caps 4 are arranged in a simple way and can be produced in a substantially faster way than a production mold for a complete housing 2. It is thus possible to respond rapidly in production to changes or requirements by the market and/or the customers, such that new cover caps 4 are produced in a relatively short period of time which are arranged on the already finished switching devices 1.

The production of a switching device 1 can also be simplified to a substantial extent by clipping on a cover cap 4. The clipping process can simply be performed both manually as well as in an automated way by a robot for example. An especially simple and durable arrangement of the cover cap 4 on the switching device 1 is achieved by the clipping. It can be provided especially that the cover cap 4 is clipped onto the housing 2 or the front side 3 of the housing 2 in a non-detachable manner. Non-detachable clipping shall be understood that a separation of two parts is not possible without at least partly destroying one of both parts, i.e. the housing 2 and/or the cover cap 4. A later change or re-labeling of the switching device can thus be prevented.

Housing 2 and/or the cover cap 4 are preferably made of an insulating material. Any insulating material can be provided which is suitable to form a respective housing 2 and/or a respective cover cap 4. It is especially provided that the insulating material concerns a plastic material which is suitable for injection-molding or extruding processes.

Figure 2:
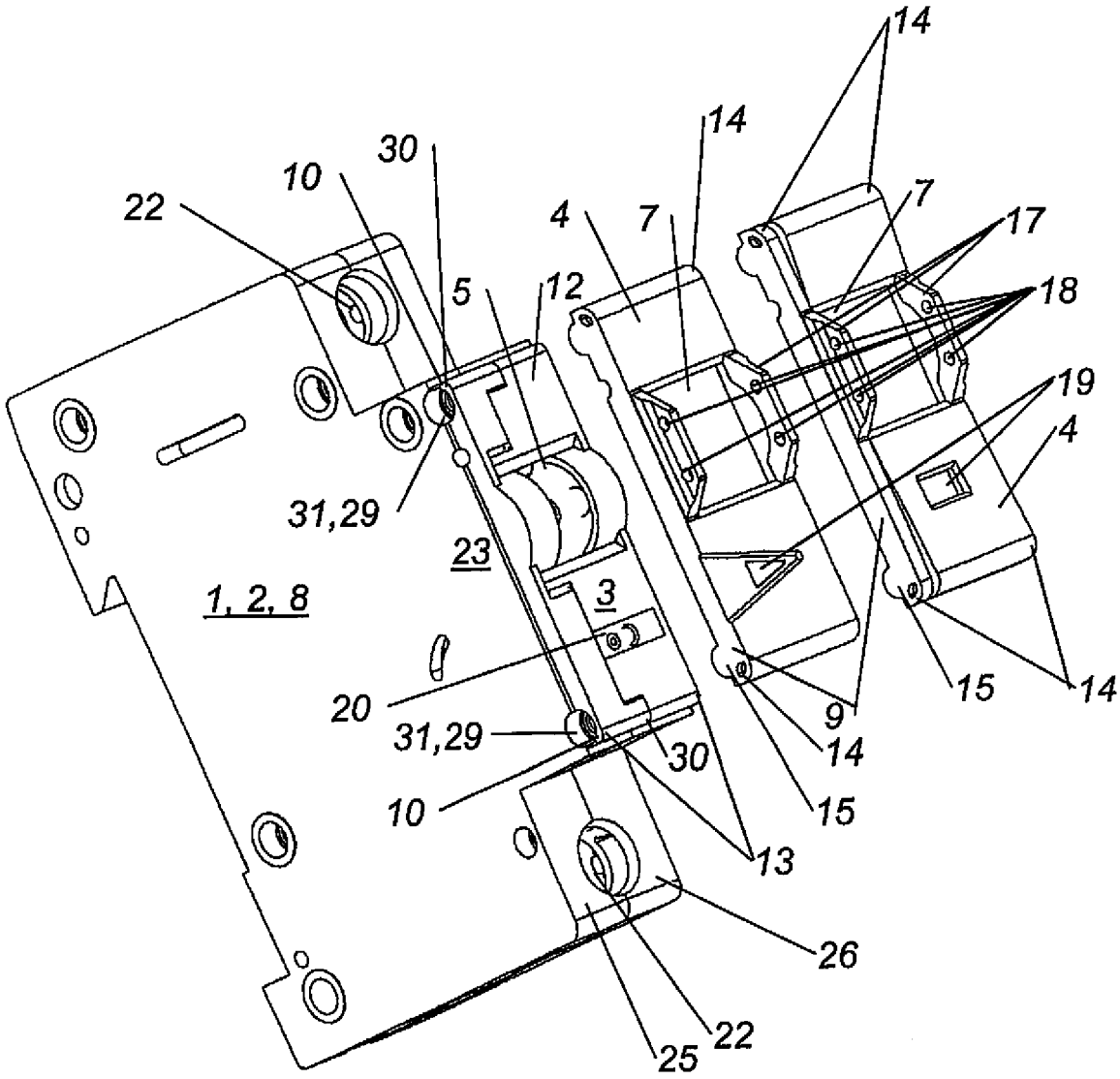
FIG. 2 shows a switching device according to FIG. 1 with a first and second embodiment of a removed cover cap.

FIG. 2 shows a switching device 1 according to FIG. 1, with the cover cap 4 being lifted off, and a second alternative embodiment of a cover cap 4. The cover cap 4 is clipped onto the front side 3 of the switching device 1. In accordance with the invention, the front side 3 concerns the part of the housing 2 which faces the user in the intended mounted position. If the switching device 1 comprises a switching lever 6, as is preferably provided, it is preferably arranged in the area of the front side 3 or penetrates the same. Switching devices 1 in accordance with the invention comprise means for connecting leads, especially in the form of terminals 21, especially screw-type terminals. Two terminals 21 are provided in the especially preferred switching device 1 according to FIGS. 1 and 2. The clamping screw openings 22 are arranged in one plane of the housing 2. A housing structure 23 or housing projection 32 rises from said plane. It is provided for in the illustrated, especially preferred embodiment of a switching device 1 that the front side 3 is formed merely by the surface which is opened up by the housing structure 23. Said front side 3 also comprises a first breakthrough 5, with the switching lever 6 protruding from the same for manually actuating the switching device 1.

In the illustrated preferred embodiment, the front side 3 has a substantially rectangular basic surface area 12, with the basic area 12 being the planar limiting surface of housing 2 in the area of the front side 3, In a switching device 1 in accordance with the invention, a cover cap 4 is clipped onto the front side 3 of the housing 2. Any kind of clipping can be provided, e.g. by means of one or several pins on the cover cap 4 which can be inserted into respectively diametrically opposite, but slightly smaller openings on the housing 2. It is provided in an especially preferred way that the cover cap 4 comprises at least one latching nose 11 which engages into a latching groove 10 arranged in the area of the front side 3. This forms a secure latched connection of the cover cap 4 with the housing 2.

It is provided in especially preferred embodiments of switching devices 1 in accordance with the invention that the housing 2 is formed by at least a first housing shell 25 and a second housing shell 26. It is also possible to provide embodiments with more than two housing shells 25, 26. The first housing shell 25 comprises a free boundary edge 27 and the second housing shell 26 comprises a second free boundary edge 28. In a finished housing 2 for a switching device 1 in accordance with the invention, the first and second housing shells 25, 26 are placed on each other and joined at their free boundary edges 27, 28. For this purpose, the first and second housing shell 25, 26 comprise tubular receptacles 31 for connecting means. Said tubular receptacles 31 are arranged in the individual housing shells 25, 26 in such a way that in the case of housing shells 25, 26 joined into a housing 2 a continuous tubular receptacle 31 is formed for receiving a connection means. Different connection means can be provided such as screws and/or rivets. It is preferably provided that the at least two housing shells 25, 26 are connected by means of rivets and are therefore riveted. The tubular receptacles 31 preferably concern so-called rivet tubes 29, i.e. tubular receptacles 31 which are provided or arranged for receiving at least one rivet, such that the rivet tubes 29 comprise diameters and/or bezels which are offset in sections and on which the rivets can rest. Preferred housings 2 comprise a predeterminable number of such rivet tubes 29. It can be provided especially that in the area of the front side 3 at least two such rivet tubes 29 are provided. It is provided in an especially preferred way that the at least two rivet pipes 29 which are preferably arranged substantially normal to the side surface 8 of the housing form an outer boundary of the front side 3, as is shown advantageously in FIG. 2. The rivet pipes 29 have a wall thickness and an outside area 30.

Figure 4:
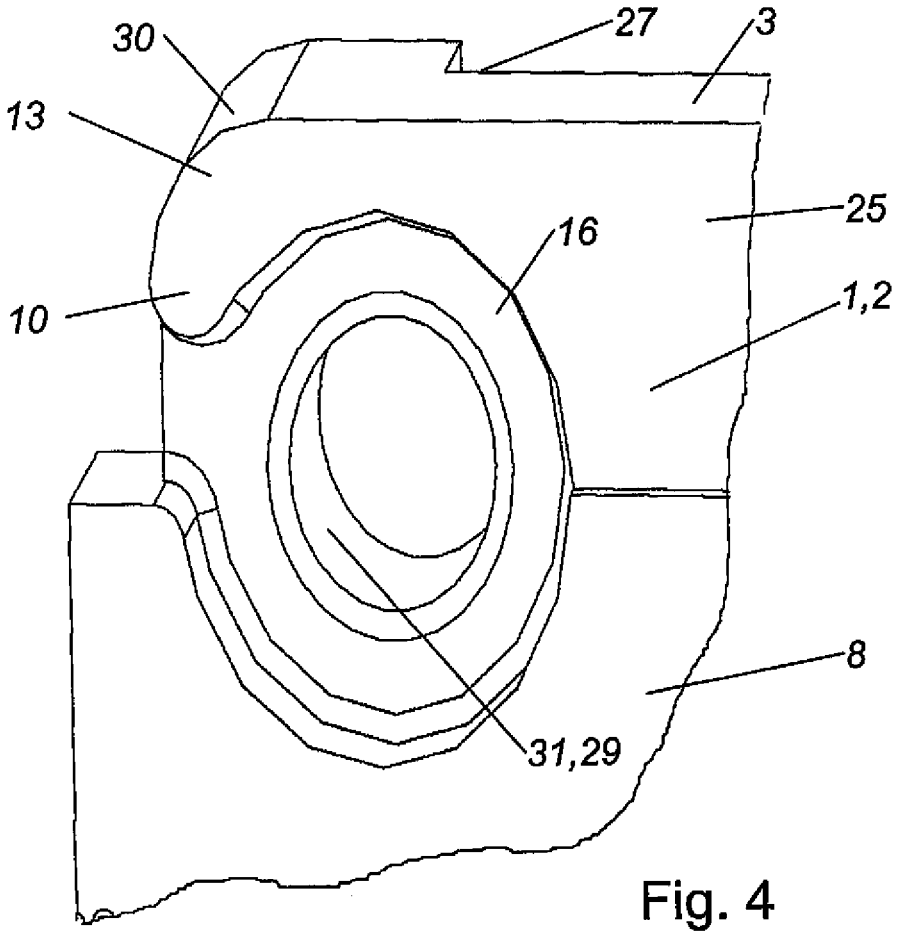
FIG. 4 shows a detail of the housing of a switching device according to FIG. 1 or 2.
Figure 5:
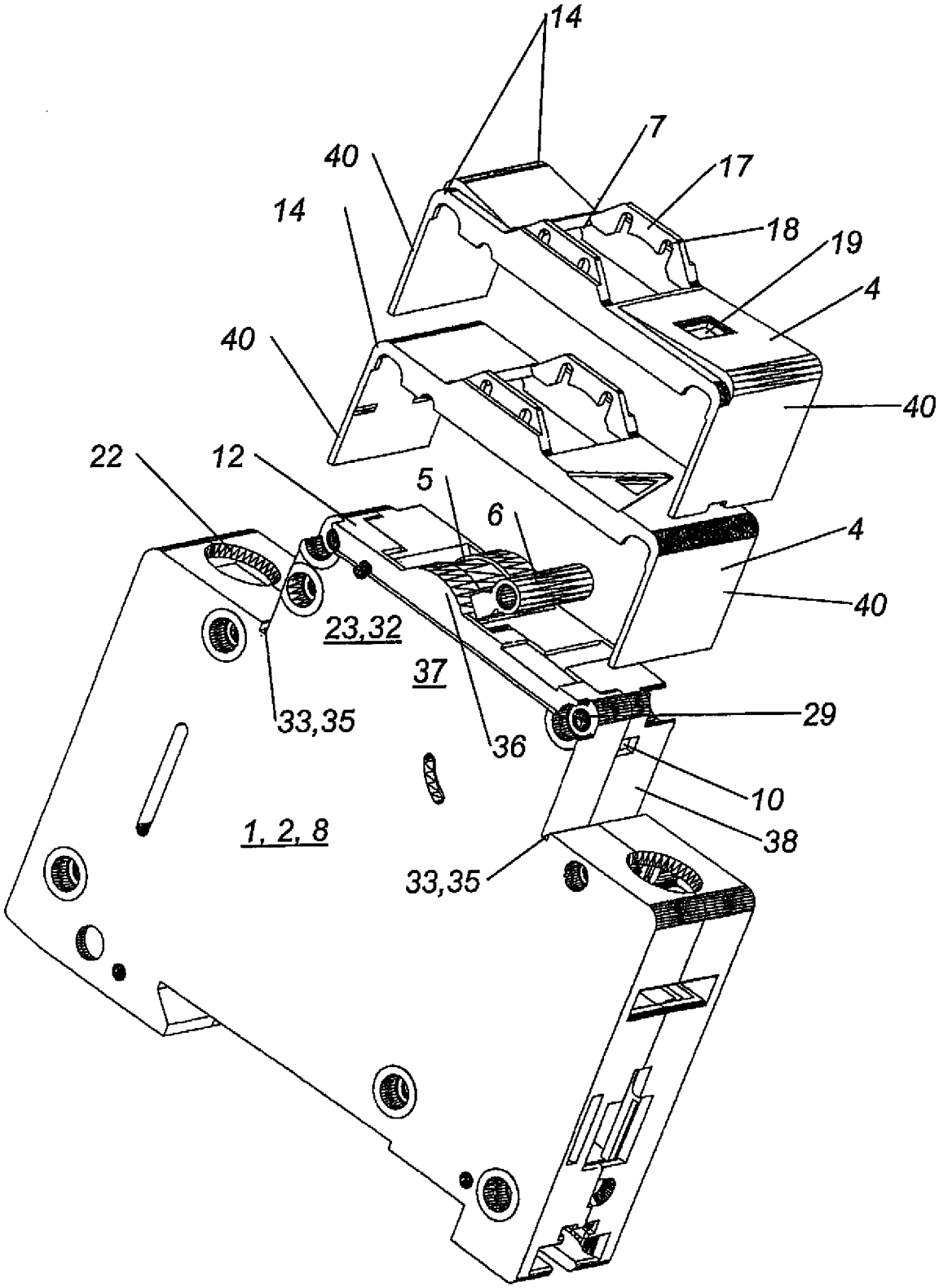
FIG. 5 shows a second embodiment of a switching device with a third and fourth embodiment of a removed cover cap.

It is therefore provided in especially preferred embodiments of a switching device 1 in accordance with the invention that the at least one latching groove 10 is formed by an outside area 30 of the rivet tubes 29. FIG. 4 shows especially well how the latching groove 10 is formed by an outside area 30 on the boundary side of rivet tube 29. It can also be provided to arrange further areas or the complete rivet tube 29 as a latching groove 10 which can then extend over the entire width of the switching device 1.

Figure 3:
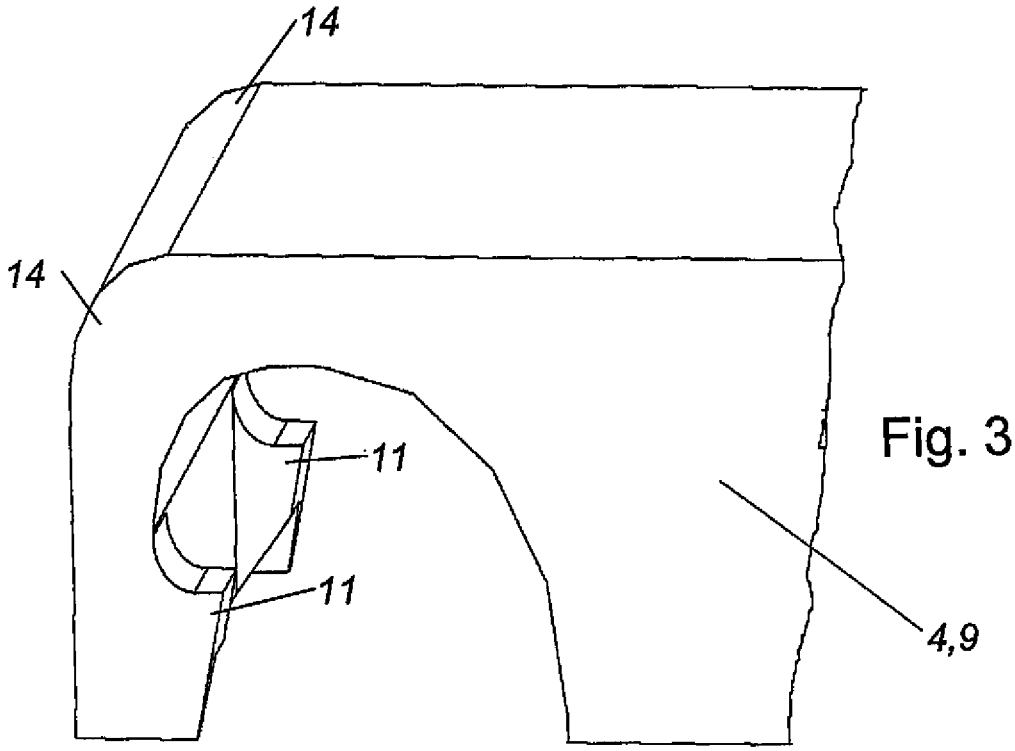
FIG. 3 shows a detail of a cover cap according to FIG. 1 or 2.

If the front side 3 and the cover cap 4 have a substantially rectangular basic surface area 12, as in the illustrated preferred embodiment, it can be preferably provided for an especially secure and durable connection of the cover cap 4 to the housing 2 that in the area of the four corners 13 on the front side at least one latching groove 10 each is arranged and in the area of the four corners 14 of the cover cap one latching nose 11 each. FIG. 3 shows a strongly enlarged view of two cover corners 14 of a cover cap 4 with the clearly recognizable latching noses 11. FIG. 4 shows a strongly enlarged detailed view of a corner 13 of a front side 3 of housing 2.

By using the rivet tubes 29 as a part of the latching grooves 10, a switching device 1 can be formed which is arranged in an especially simple way and which already has full functionality even without the cover cap 4.

FIGS. 5 to 8 show a second preferred embodiment of a switching device 1 in accordance with the invention with a cover cap 4 that is clipped on or can be clipped on. The above described embodiments for a latching connection 41, a latching nose 11 and a latching groove 10 can also be provided in the subsequently described embodiments, especially also the embodiment of the latching groove 10 as a partial section of the rivet tubes 29.

Figure 7:
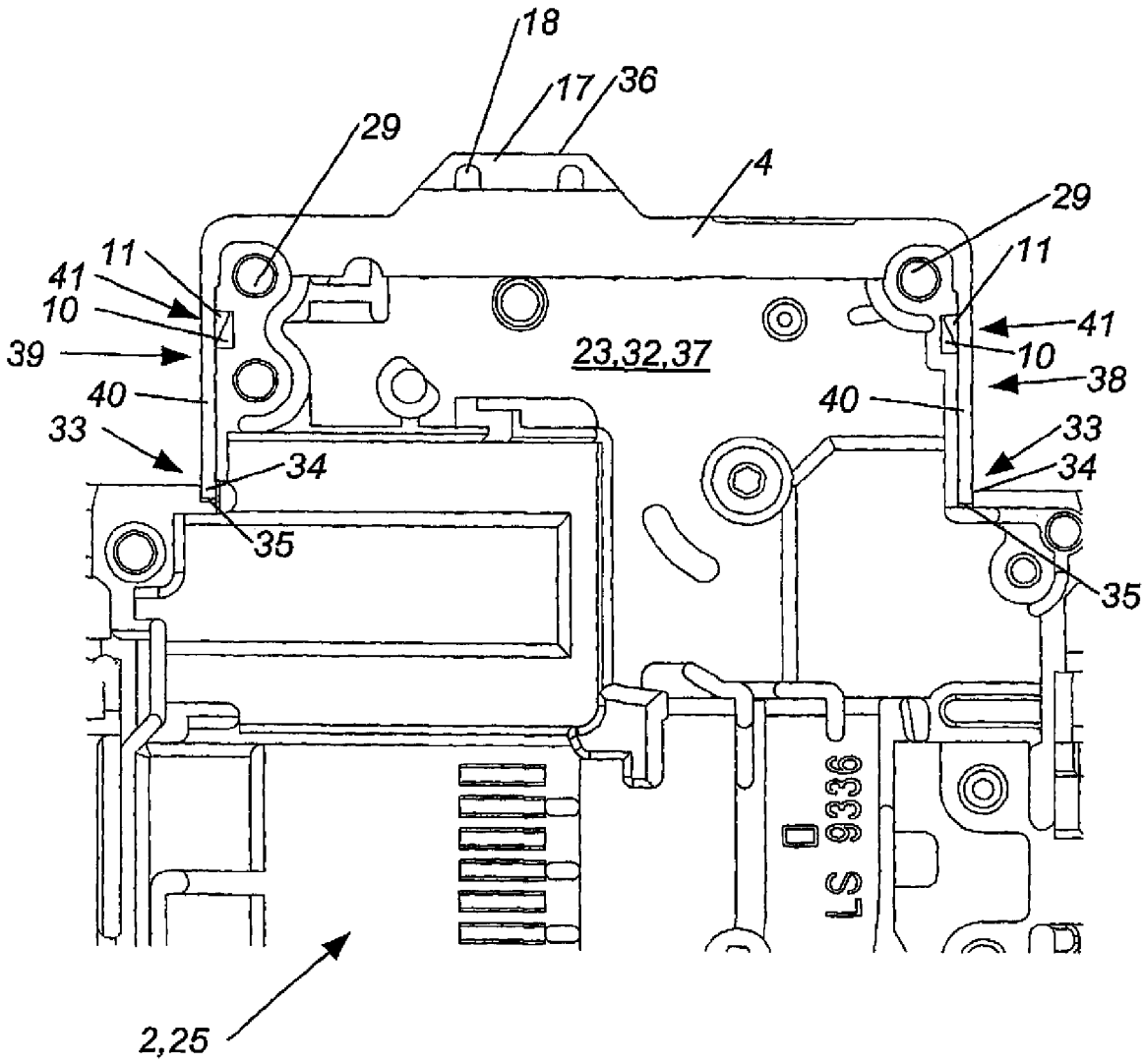
FIG. 7 shows a detail of the first housing shell and the cover cap of a switching device according to FIG. 6.
Figure 8:
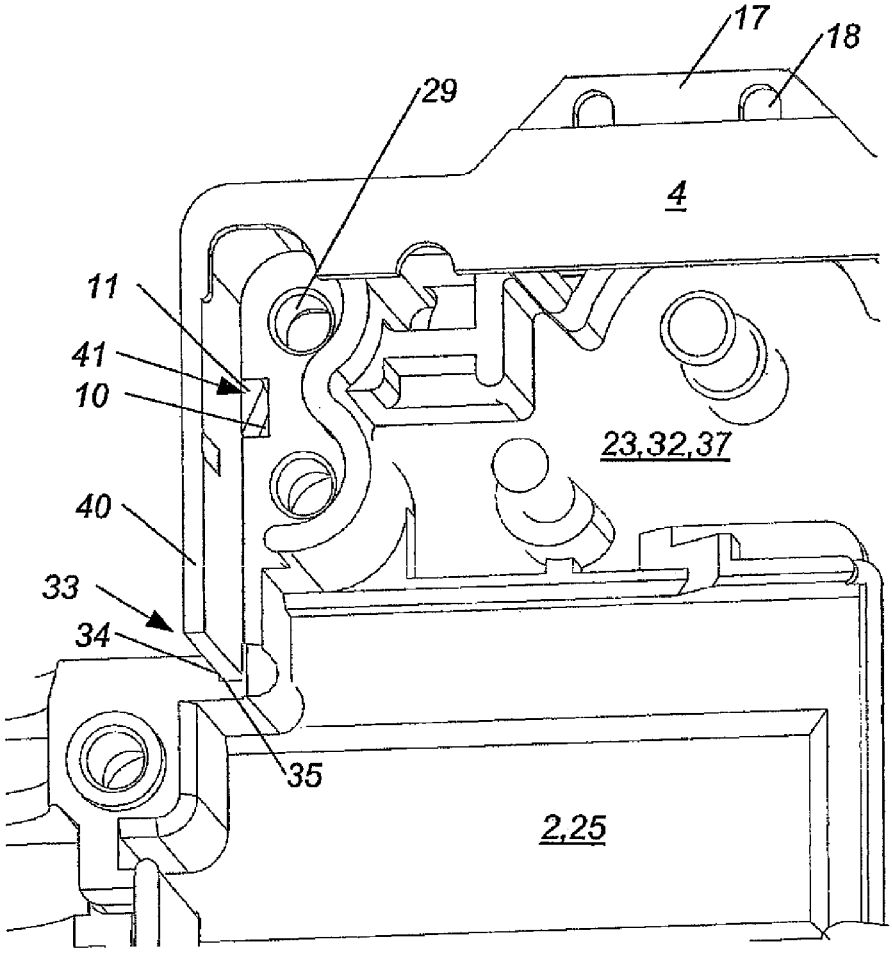
FIG. 8 shows a detail of the arrangement according to FIG. 7 in an axonometric view.

It is preferably provided in the embodiments according to FIGS. 5 to 8 that the latching nose 11 is arranged as a wedge-like projection in the area of a securing extension 40 of the cover cap 4, with the securing extension 40 of the cover cap 4 being arranged to preferably rest on the front side 3 or the adjacent housing 2. As is shown especially in FIG. 5, housing 2 is preferably formed by at least two housing shells 25, 26 which are placed against each other with their free boundary edges 27, 28 and are riveted together. As is shown in FIGS. 7 and 8, it is especially provided that a latching groove 10 each is arranged on the first and second face side 38, 39 of merely one of the two housing shells 27, 28, with the latching groove 10 being provided and arranged for receiving the latching nose 11.

It can be provided in an especially preferred way in a switching device 1 in accordance with the invention that the cover cap 4 and the housing 2 are arranged in such a way that when the cover cap 4 is clipped onto the front side 3 a destruction-free opening is prevented, especially a destruction-free upward bending of the latched connection 41 formed by the latching groove 10 and the latching nose 11. Any kind of arrangement can be provided in accordance with the invention which prevents the destruction-free opening and especially the destruction-free upward bending of the latched connection 41 consisting of the latching groove 10 and the latching nose 11, e.g. by an interlocking connection of the cover cap 4 to the housing 2 which prevents an upward bending of the latched connection 41 or by arranging a fastening means such as a screw. It is preferably provided that the housing 2 and the cover cap 4 are arranged in such a way that no further tools are necessary for achieving the above described effect.

FIGS. 5 to 8 show especially preferred embodiments of a switching device 1 in accordance with the invention, with the housing 2 having a projection 32 which forms the front side 3 at least in sections. The projection 32 especially concerns the projection 32 which is usually present in conventional circuit breakers and in which a manual operating member, especially a switching lever 6, is arranged. As is shown, the projection 32 converges into the housing 2 at least in a base region 33. It is provided in an especially preferred way as shown that the cover cap is connected with the housing 2 and/or the projection 32 in a securing connection 34, especially in the area of at least one base area 33, and that the securing connection 34 is arranged in such a way that it prevents destruction-free opening, especially destruction-free upward bending, of the latched connection 41. As already explained, any kind of securing connection can be provided, e.g. by provided a housing extension in the area of the cover cap 4, especially in the area of the latched connection 41, thus preventing prying open the latched connection 41 or the application of a tool.

It is preferably provided that in the area of the base area 33, especially in the direct transition of the housing projection 32 into the housing 2, at least one securing groove 35 is arranged in the housing 2 and the cover cap 4 engages in the securing groove 35 and thus forms the securing connection 34. The securing groove 35 can be arranged both to extend over the entire width of the housing 2, or also that the securing groove 35 extends merely over parts of the width of the housing 2 and is arranged as a pocket hole which is round for example. It is also possible to arrange a predeterminable number of securing grooves 35 in different or similar arrangement next to one another.

In order to prevent the upward bending and/or opening of the latched connection 41 in an especially effective way, it is preferably provided that the at least one latched connection 41 is arranged in the region between the securing connection 34 and an apex region 36 of the projection 32 of the housing, with the apex region 36, like the peak value of a mathematical curve, being the highest elevation of the projection 32 of the housing.

FIGS. 5 to 8 show an especially preferred embodiment of a securing groove 35 as a latching or insertion groove, into which a portion of the cover cap 4 can be inserted or latched. In the illustrated embodiments, the front side 3 is formed by the housing projection 32 and the housing projection 32 is arranged to substantially have the shape as a rectangular cuboid 37 placed on the housing 2 and comprising a first and second face surface 38, 39. A securing groove 35 is each arranged in the region of the base area 33 of the first and second face surface 38, 39, which securing groove is arranged as a recess in the housing 2 or base area 33 which follows in a substantially straight line the first and/or second face surface 38, 39. The cover cap 4 comprises a securing extension 40 each while resting on the first and second face surface 38, 39. It engages in the securing groove 35 and forms a securing connection 34 each in the area of the first and second face side 38, 39. Such a securing connection 34 permanently prevents the removal of the cover cap 4, since prying open the latched connection 41 is made substantially impossible without thus destroying the switching device 1, because the application of a tool is prevented to the highest possible extent. Such a cover cap 4 according to FIGS. 5 to 8 can be attached quickly and easily to a switching device 1 even with simple automatic production machines.

It is preferably provided that the switching device 1 comprises a housing 2 with two substantially parallel side surfaces 8. It can be provided that in the case of such housings 2 a cover cap 4 is provided which comprises at least one cover side surface 9 and that said cover side surface 9 is substantially flush with the adjacent side surface 8 of the housing. In such an arrangement, housing 2 is constricted opposite the side surfaces 8 of the housing in the area of the front side 3 or in the area which will later assume the cover cap 5 in order to enable the above-mentioned flush or planar connection of the cover side surface 9 to the side surfaces 8 of the housing. This helps produce a torsionally rigid cover cap 4 which will also withstand loads by the production robot. A switching device 1 is thus formed which does not have any visible or accessible gaps in the housing in the area accessible to the user.

As already explained, the front side 3 preferably comprises a first breakthrough 5 for leading through the switching lever 6. It is preferably provided in such an embodiment that the cover cap 4 covers the front side 3 in a substantially complete way and that the cover cap 4 has a second breakthrough 7 which is at least as large as the first breakthrough 5. The second breakthrough 7 is preferably as large as the first breakthrough 5 in the direction of movement of the switching lever 6 and substantially as large or as wide as the handle 24 of switching lever 6 rectangular to the direction of movement of the switching lever 6.

It can be provided for guiding the switching lever 6 or for protecting the same from the actions of lateral forces that the second breakthrough 7 is delimited in the area of the cover side surface 9 by at least one rib, especially two ribs 17. It can be provided for especially as shown that the at least one rib 17 comprises at least one hole, especially two holes 18 for guiding through a switching-lever arresting element such as a wire. By inserting a switching-lever arresting element such as a wire, the switching lever 6 can be arrested in one of the two end positions in order to prevent any inadvertent actuation of the switching lever 1.

It is provided especially preferably in switching devices 1 which comprise a switch position display 20 that the cover cap 4 comprises a third breakthrough 19 for a switch position display 20, through which the position of the switching contacts of the switching device 1 can be displayed even when using a cover cap 4 The third breakthrough 19 can be adapted in its shape and configuration to the requirements of a market and/or a third-party supplier. FIG. 2 shows a switching device 1 with two different or alternative cover caps 4 which have a differently arranged third breakthrough 19. Stockkeeping can thus be reduced substantially, and production is able to produce different arrangements of a switching device 1 in a quick and easy manner.

As is provided in the embodiments according to FIGS. 1 and 2, it can be provided that the cover cap 4 comprises at least one extension 15 for covering at least one of the tubular recesses 31, which are especially rivet tubes 29. Tubular recesses 31 can thus be covered, which may contribute to preventing subsequent manipulations on the switching device 1. It can be provided especially preferably that the at least one extension 15 is arranged in the area of the at least one latching nose 11, especially in the area of the cover side surface 9. In this way, especially the rivet tubes 29 arranged on the side of the housing 2 can be sealed.

Any combination of features, especially also the different described embodiments of the invention, can be provided within the scope of the invention, even when they are not described explicitly as a combination.

What is claimed is:

1. A switching device, comprising:

a housing including a projection having at least a section to form a front side and converging into the housing in at least one base area;

a tripping apparatus for automatically disconnecting switching contacts for closing and/or opening at least one circuit;

a cover cap clipped onto the front side of the housing and comprising at least one latching nose which engages in at least one latching groove in the housing for forming a latched connection, wherein the housing is provided with at least one securing groove in the base area adjacent the projection of the housing, with the cover cap engaging in the securing groove to form a securing connection, said securing connection preventing upward bending and disengagement of the latched connection.

2. The switching device of claim 1, further comprising a switching lever arranged in a region of the projection of the housing.

3. The switching device of claim 1, wherein the securing connection is arranged in a region of the at least one base area.

4. The switching device of claim 1, wherein the securing groove is arranged in an area of direct transition of the projection to the housing.

5. The switching device of claim 1, wherein the at least one latched connection is arranged in the region between the securing connection and an apex zone of the projection of the housing.

6. The switching device of claim 1, wherein the front side and the projection substantially have the shape of a rectangular cuboid placed on the housing and defining first and second end surfaces, wherein the switching device has two said securing groove, with one of the two securing grooves being provided in one of the first and second end surfaces and the other one of the two securing grooves being provided in the other one of the first and second end surfaces, wherein the cover cap has two securing projections adjacent to the first and second end surfaces for engagement in the two securing grooves in one-to-one correspondence to thereby form the securing connection in the area of each of the first and second end surfaces.

7. The switching device of claim 6, wherein the housing is formed by at least two housing shells placed adjacent to each other with their free boundary edges and riveted together, wherein the first and second end surfaces of only one of the two housing shells have each a latching groove.

8. The switching device of claim 1, wherein the housing is formed by at least two housing shells placed adjacent to each other with their free boundary edges and riveted together, with the housing shells each having riveting tubes converging into each other for receiving rivets, wherein the at least one latching groove formed by an outside area of the rivet tubes.

9. The switching device of claim 1, wherein the front side and the cover cap have a substantially rectangular base surface defining four front-side corners, wherein in the area of each of the four front-side corners at least one latching groove is arranged, and wherein the cover cap has four cover corners, with at least one latching nose in each area of the four cover corners.

10. The switching device of claim 1, wherein the front side has at least a first breakthrough for passage of a switching lever, said cover cap substantially covering the front side and including a second breakthrough sized at least as large as the first breakthrough.

11. The switching device of claim 1, wherein the housing has two substantially parallel side surfaces, said cover cap comprising at least one cover side surface which is substantially flush with an adjacent one of the side surfaces of the housing.

12. The switching device of claim 11, wherein the cover cap has a second breakthrough provided in an area of the cover side surface and delimited by at least one rib.

13. The switching device of claim 12, wherein the second breakthrough is delimited by two ribs.

14. The switching device of claim 12, wherein the at least one rib comprises at least one hole for passage of a switching lever arresting element.

15. The switching device of claim 14, wherein the rib has two holes.

16. The switching device of claim 12, wherein the switching lever arresting element is a wire.

17. The switching device of claim 1, wherein the cover cap comprises a third breakthrough for a switch position indicator.

18. The switching device of claim 1, constructed in the form of a miniature circuit breaker or a residual current circuit breaker.

* * * * *